US011448174B2

(12) United States Patent
Kato et al.

(10) Patent No.: US 11,448,174 B2
(45) Date of Patent: Sep. 20, 2022

(54) ELECTROMAGNETIC VALVE DRIVING DEVICE

(71) Applicants: Hitachi Astemo, Ltd., Hitachinaka (JP); Nuvoton Technology Corporation Japan, Nagaokakyo (JP)

(72) Inventors: Motoaki Kato, Hitachinaka (JP); Atsushi Ogawa, Hitachinaka (JP); Kengo Nomura, Hitachinaka (JP); Keisuke Kuroda, Osaka (JP)

(73) Assignees: HITACHI ASTEMO, LTD., Ihitachinaka (JP); NUVOTON TECHNOLOGY CORPORATION JAPAN, Nagaokakyo (JP)

( * ) Notice: Subject to any disclaimer, the term of this patent is extended or adjusted under 35 U.S.C. 154(b) by 0 days.

(21) Appl. No.: 17/405,502

(22) Filed: Aug. 18, 2021

(65) Prior Publication Data

US 2022/0099059 A1 Mar. 31, 2022

(30) Foreign Application Priority Data

Sep. 30, 2020 (JP) ..... JP2020-164330

(51) Int. Cl.
*F02D 41/20* (2006.01)
*F02M 51/06* (2006.01)

(52) U.S. Cl.
CPC ..... *F02M 51/065* (2013.01); *F02D 41/20* (2013.01); *F02D 2041/201* (2013.01); *F02D 2041/2006* (2013.01); *F02D 2041/2013* (2013.01); *F02D 2041/2044* (2013.01); *F02D 2041/2082* (2013.01); *F02D 2041/2086* (2013.01); *F02D 2041/2089* (2013.01); *F02D 2041/2093* (2013.01)

(58) Field of Classification Search
CPC ..... F02D 41/20; F02D 2041/2006; F02D 2041/201; F02D 2041/2013; F02D 2041/2044; F02D 2041/2082; F02D 2041/2086; F02D 2041/2089; F02D 2041/2093
See application file for complete search history.

(56) References Cited

U.S. PATENT DOCUMENTS

2009/0107469 A1* 4/2009 Takahashi ..... F02D 41/221 123/490
2015/0152820 A1* 6/2015 Kojima ..... F01L 9/20 123/479

FOREIGN PATENT DOCUMENTS

JP 2018031294 A 3/2018

* cited by examiner

*Primary Examiner* — Erick R Solis
(74) *Attorney, Agent, or Firm* — Cantor Colburn LLP

(57) ABSTRACT

An electromagnetic valve driving device which drives a fuel injection valve having a solenoid coil, includes: a regenerative switching element disposed between a first end portion of the solenoid coil and the ground; and a control unit configured to control the regenerative switching element to be in an ON state or an OFF state, wherein the control unit includes: a voltage detection unit configured to detect a voltage of the first end portion of the solenoid coil; and an abnormality detection unit configured to detect an abnormality of the regenerative switching element on the basis of the voltage detected by the voltage detection unit.

6 Claims, 6 Drawing Sheets

ELECTROMAGNETIC VALVE DRIVING DEVICE

BACKGROUND OF THE INVENTION

Cross Reference to Related Applications

The present invention claims priority under 35 U.S.C. § 119 to Japanese Application No. 2020-164330 filed Sep. 30, 2020, the entire content of which is incorporated herein by reference.

FIELD OF THE INVENTION

The present invention relates to an electromagnetic valve driving device.

DESCRIPTION OF RELATED ART

Japanese Unexamined Patent Application. First Publication No. 2018-31294 discloses an electromagnetic valve driving device adapted to open a fuel injection valve through energization of a solenoid coil of the fuel injection valve.

The electromagnetic valve driving device includes a control unit configured to cause a current generated due to a back electromotive voltage of the solenoid coil (hereinafter referred to as a "regenerative current") to return from the ground to the solenoid coil via a switching element (hereinafter referred to as a "synchronous switching element").

SUMMARY OF THE INVENTION

For example, when an abnormality such as an opening of a drain terminal of the synchronous switching element occurs due to various causes, a path through which a regenerative current is caused to return to the solenoid coil is removed. Thus, when a back electromotive voltage is generated in the solenoid coil, a current exceeding a specified value is likely to flow from the control unit toward the solenoid coil. Therefore, although a constitution in which an abnormality in a synchronous switching element is detected is required. Japanese Unexamined Patent Application, First Publication No. 2018-31294 does not describe this constitution.

The present invention was made in view of such circumstances, and an object of the present invention is to provide an electromagnetic valve driving device in which an abnormality in a synchronous switching element can be detected.

(1) An aspect of the present invention is an electromagnetic valve driving device which drives a fuel injection valve having a solenoid coil, including: a regenerative switching element disposed between a first end portion of the solenoid coil and a ground; and a control unit configured to control the regenerative switching element to be in an ON state or an OFF state, wherein the control unit includes: a voltage detection unit configured to detect a voltage of the first end portion of the solenoid coil; and an abnormality detection unit configured to detect an abnormality of the regenerative switching element on the basis of the voltage detected by the voltage detection unit.

(2) In the electromagnetic valve driving device of (1) described above, the control unit may include a drive control unit configured to control the regenerative switching element to be in an ON state or an OFF state, and the abnormality detection unit may detect an abnormality of the regenerative switching element on the basis of the voltage detected by the voltage detection unit when the drive control unit controls the regenerative switching element to be in an ON state.

(3) In the electromagnetic valve driving device of (2) described above, the abnormality detection unit may detect an abnormality of the regenerative switching element when the voltage detected by the voltage detection unit is a prescribed value or higher before the fuel injection valve is driven.

(4) In the electromagnetic valve driving device of (3) described above, the electromagnetic valve driving device may further include: a boost circuit configured to step up a battery voltage which is an output voltage of a battery; a first switching element disposed between the boost circuit and the first end portion of the solenoid coil; a second switching element disposed between the battery and the first end portion; a third switching element disposed between a second end portion of the solenoid coil and a ground; and a first switch which is disposed between the second end portion and a ground and is different from the third switching element, and, when the voltage detected by the voltage detection unit is the prescribed value or higher, the abnormality detection unit may detect an abnormality of the regenerative switching element if both of the regenerative switching element and the first switch are in an ON state.

(5) In the electromagnetic valve driving device of (4) described above, the electromagnetic valve driving device may further include: a bootstrap capacitor configured to generate a voltage required for turning on the first switching element and the second switching element; and a second switch disposed between the bootstrap capacitor and a ground, and the drive control unit may control the second switch to be in an ON state to cause the bootstrap capacitor to be charged with electricity, and when the second switch is in an OFF state and both of the regenerative switching element and the first switch are in an ON state, the abnormality detection unit may detect an abnormality of the regenerative switching element if the voltage detected by the voltage detection unit is the prescribed value or higher.

(6) In the electromagnetic valve driving device according to any one of (1) to (5) above, the control unit may stop the driving of the fuel injection valve when an abnormality of the regenerative switching element is detected.

As described above, according to the above aspect of the present invention, it is possible to detect an abnormality in a synchronous switching element.

DETAILED DESCRIPTION OF THE INVENTION

An electromagnetic valve driving device according to an embodiment will be described below with reference to the drawings.

An electromagnetic valve driving device 1 according to the embodiment is a drive device configured to drive a fuel injection valve L. To be specific, the electromagnetic valve driving device 1 according to the present embodiment is an electromagnetic valve driving device having, as a drive target, the fuel injection valve L (an electromagnetic valve) through which fuel is injected to an internal combustion engine installed in a vehicle.

The fuel injection valve L is an electromagnetic valve (a solenoid valve) through which fuel is injected to an internal combustion engine such as a gasoline engine or a diesel engine installed in a vehicle.

A configuration example of the fuel injection valve L will be described below with reference to FIG. 1.

Figure 1:
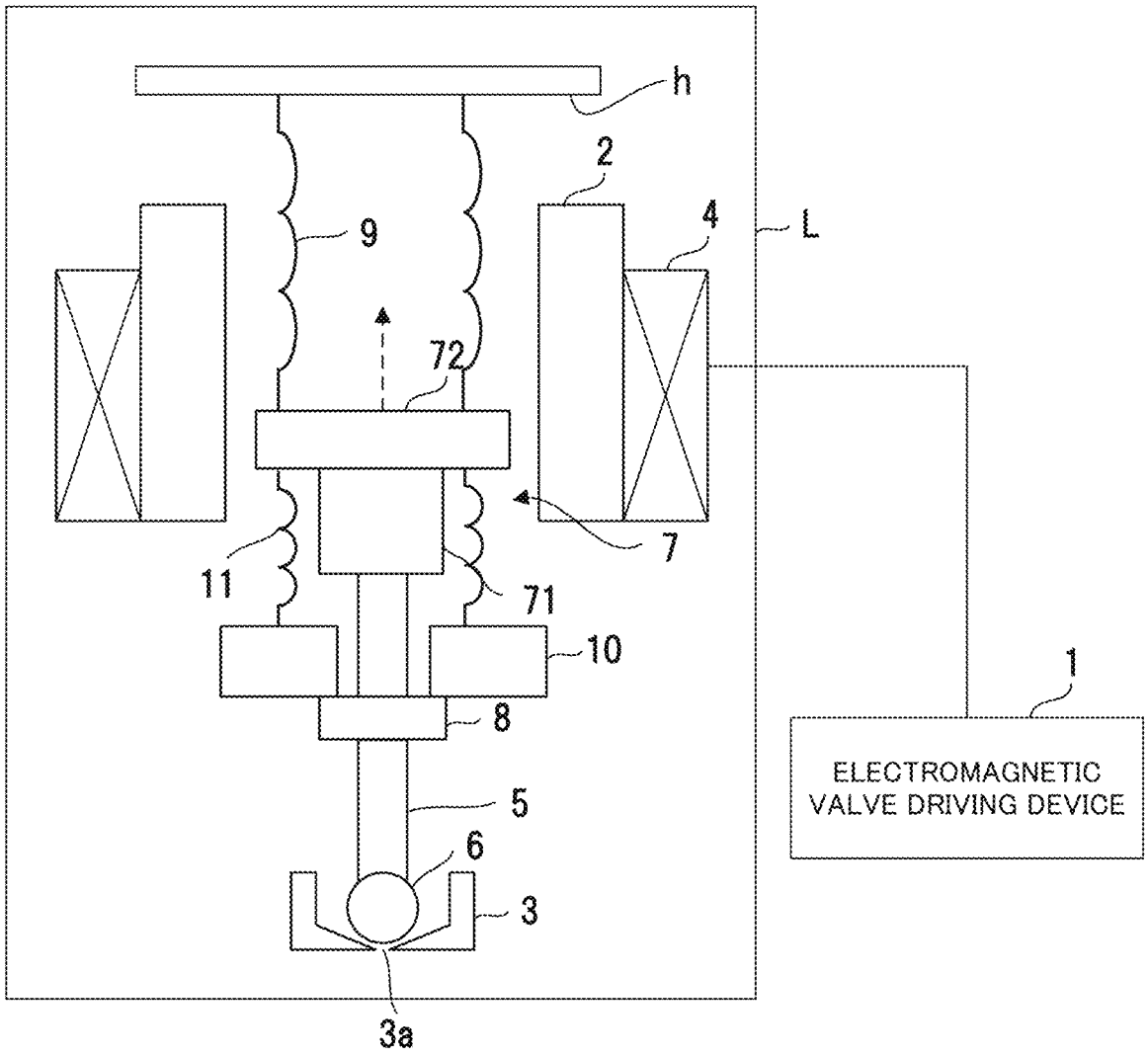
FIG. 1 is a schematic diagram illustrating a configuration example of a fuel injection valve according to an embodiment.

As illustrated in FIG. 1, the fuel injection valve L includes a fixed core 2, a valve seat 3, a solenoid coil 4, a needle 5, a valve body 6, a retainer 7, a lower stopper 8, a valve body biasing spring 9, a movable core 10, and a movable core biasing spring 11. In the present embodiment, the fixed core 2, the valve seat 3, and the solenoid coil 4 are fixed members and the needle 5, the valve body 6, the retainer 7, the lower stopper 8, the valve body biasing spring 9, the movable core 10, and the movable core biasing spring 11 are movable members.

The fixed core 2 is a cylindrical member and is fixed to a housing (not shown) of the fuel injection valve L. The fixed core 2 is made of a magnetic material.

The valve seat 3 is fixed to the housing of the fuel injection valve L. The valve seat 3 has an injection hole 3*a*.

The injection hole 3*a* is a hole through which fuel is injected, closed when the valve body 6 sits on the valve seat 3, and opened when the valve body 6 is away from the valve seat 3.

The solenoid coil 4 is formed by winding an electric wire in an annular shape. The solenoid coil 4 is arranged concentrically with the fixed core 2.

The solenoid coil 4 is electrically connected to the electromagnetic valve driving device 1. The solenoid coil 4 receives electricity supplied from the electromagnetic valve driving device 1 to form a magnetic path in which the fixed core 2 and the movable core 10 are included.

The needle 5 is a long rod member extending along a central axis of the fixed core 2. The needle 5 moves in an axial direction of the central axis of the fixed core 2 (in a direction in which the needle 5 extends) using an attractive force generated due to the magnetic path including the fixed core 2 and the movable core 10. In the following description, in the axial direction of the central axis of the fixed core 2, a direction in which the movable core 10 moves due to the attractive force is referred to as an "upward direction" and a direction opposite to the direction in which the movable core 10 moves due to the attractive force is referred to as a "downward direction."

The valve body 6 is formed at a lower distal end of the needle 5. The valve body 6 closes the injection hole 3*a* when sitting on the valve seat 3 and opens the injection hole 3*a* when being away from the valve seat 3.

The retainer 7 includes a guide member 71 and a flange 72.

The guide member 71 is a cylindrical member fixed to an upper end of the needle 5.

The flange 72 is provided at an upper end portion of the guide member 71. The flange 72 is formed to protrude in a radial direction of the needle 5. That is to say, the flange 72 has an outer diameter dimension larger than that of the guide member 71.

A lower end surface of the flange 72 is a surface in which the flange 72 is in contact with the movable core biasing spring 11. Furthermore, an upper end surface of the flange 72 is a surface in which the flange 72 is in contact with the valve body biasing spring 9.

The lower stopper 8 is a cylindrical member fixed to the needle 5 at a position between the valve seat 3 and the guide member 71. An upper end surface of the lower stopper 8 is a surface in which the lower stopper 8 is in contact with the movable core 10.

The valve body biasing spring 9 is a compression coil spring accommodated inside the fixed core 2 and inserted between an inner wall surface h of the housing and the flange 72. The valve body biasing spring 9 biases the valve body 6 downward. That is to say, when electricity is not supplied to the solenoid coil 4, the valve body 6 is brought into contact with the valve seat 3 due to a biasing force of the valve body biasing spring 9.

The movable core 10 is disposed between the guide member 71 and the lower stopper 8. The movable core 10 is a cylindrical member and is provided coaxially with the needle 5. The movable core 10 has a through hole through which the needle 5 is inserted formed in a center thereof and can move in the direction in which the needle 5 extends.

An upper end surface of the movable core 10 is a surface in which the movable core 10 is in contact with the fixed core 2 and the movable core biasing spring 11. On the other hand, a lower end surface of the movable core 10 is a surface in which the movable core 10 is in contact with the lower stopper 8. The movable core 10 is formed of a magnetic material.

The movable core biasing spring 11 is a compression coil spring inserted between the flange 72 and the movable core 10. The movable core biasing spring 11 biases the movable core 10 downward. That is to say, when electricity is not supplied to the solenoid coil 4, the movable core 10 is brought into contact with the lower stopper 8 due to a biasing force of the movable core biasing spring 11.

The electromagnetic valve driving device 1 according to the present embodiment will be described below.

Figure 2:
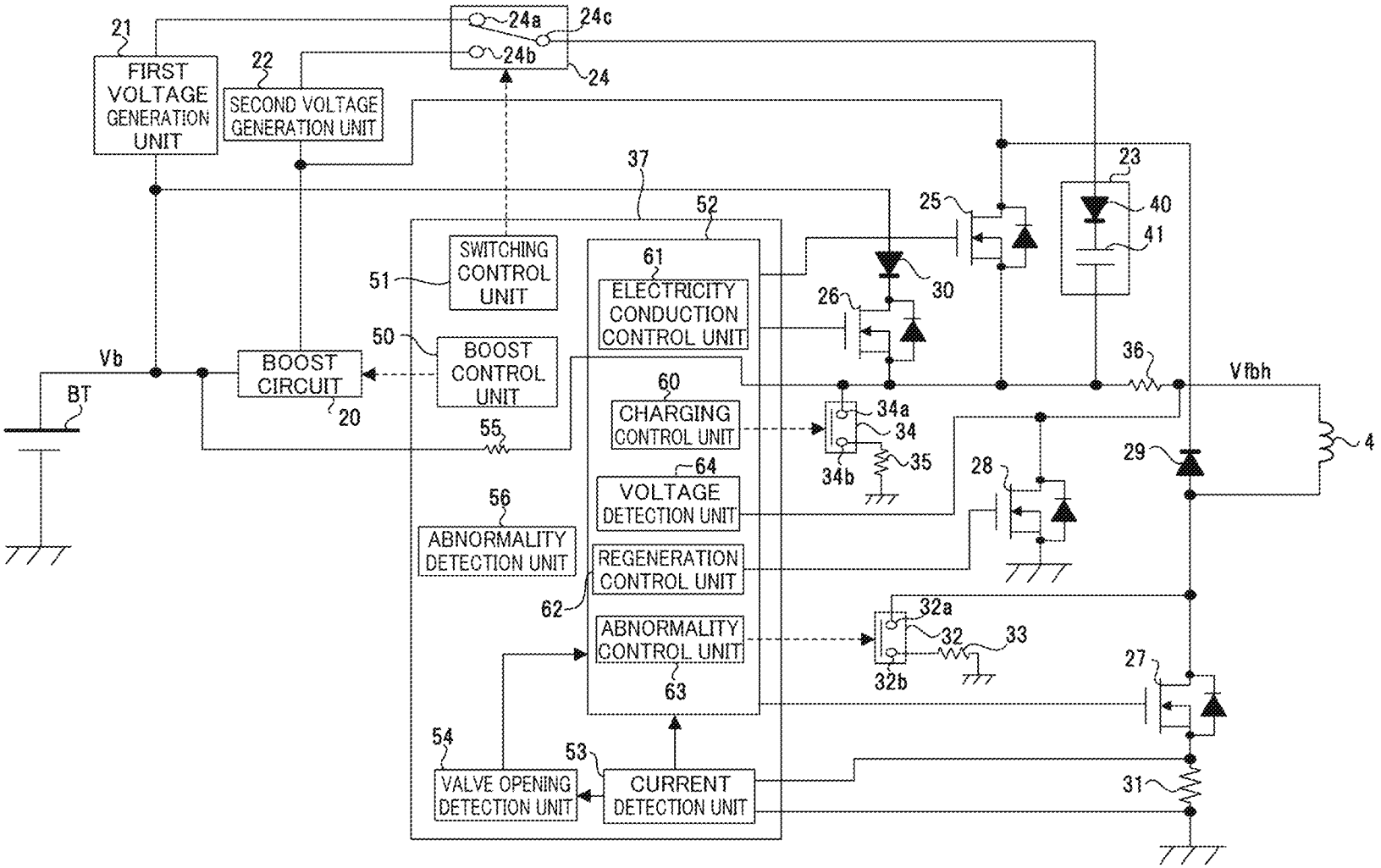
FIG. 2 is a circuit diagram illustrating a configuration example of an electromagnetic valve driving device according to the embodiment.

As illustrated in FIG. 2, the electromagnetic valve driving device 1 includes a boost circuit 20, a first voltage generation unit 21, a second voltage generation unit 22, a bootstrap circuit 23, a switching unit 24, a first switching element 25 to a fourth switching element 28, a first diode 29, a second diode 30, a current detection resistor 31, a first switch 32, a limiting resistor 33, a second switch 34, a limiting resistor 35, a resistor 36, and a control unit 37. The first switch 32 and the like may be installed in the control unit 37.

The boost circuit 20 steps up a battery voltage Vb which is an output voltage of a battery BT installed in the vehicle to a prescribed voltage. For example, the boost circuit 20 is a chopper circuit. The boost circuit 20 steps up a battery voltage to generate a stepped-up voltage Vs. The boost circuit 20 has a booster ratio of, for example, about ten to several tens and an operation thereof is controlled by the control unit 37.

The first voltage generation unit 21 steps down the battery voltage Vb to generate a first voltage V1. For example, the first voltage generation unit 21 includes a DC-DC converter such as a linear regulator or a switching regulator.

The second voltage generation unit 22 steps down the stepped-up voltage Vs to generate a second voltage V2. For example, the second voltage generation unit 22 includes a DC-DC converter such as a linear regulator or a switching regulator. The first voltage V1 and the second voltage V2 have the same voltage value. Here, the first voltage V1 and the second voltage V2 may have different voltage values.

The bootstrap circuit 23 generates a voltage (hereinafter referred to as a "boot voltage") Vboot required for controlling a switching element on a high-side side (hereinafter referred to as a "high-side side switching element") to be in an ON state. The high-side side switching element is at least one of the first switching element 25 and a second switching element 26. The bootstrap circuit 23 generates a boot voltage from either the first voltage V1 or the second voltage V2. The bootstrap circuit 23 includes a diode 40 and a bootstrap capacitor 41.

The diode 40 has an anode connected to the switching unit 24 and a cathode connected to the bootstrap capacitor 41.

The bootstrap capacitor 41 has a first end portion connected to the cathode of the diode 40 and a second end portion connected to sources of the first switching element 25 and the second switching element 26. The bootstrap circuit 23 generates a boot voltage Vboot by charging the bootstrap capacitor 41 with electricity.

The switching unit 24 switches a charging path through which the bootstrap capacitor 41 is charged with electricity between a first charging path and a second charging path. The first charging path is a path through which the bootstrap capacitor 41 is charged with electricity from the battery BT without passing through the boost circuit 20. The first charging path in the embodiment is a path through which the bootstrap capacitor 41 is charged with electricity by applying the first voltage V1 generated using the first voltage generation unit 21 to the bootstrap capacitor 41. Here, the present invention is not limited to this constitution and the first charging path may be a path through which the bootstrap capacitor 41 is charged with electricity by applying the battery voltage Vb to the bootstrap capacitor 41.

The second charging path is a path through which the bootstrap capacitor 41 is charged with electricity from the boost circuit 20. The second charging path in the embodiment is a path through which the bootstrap capacitor 41 is charged with electricity by applying the second voltage V2 generated using the second voltage generation unit 22 to the bootstrap capacitor 41. Here, the present invention is not limited to this constitution and the second charging path may be a path through which the bootstrap capacitor 41 is charged with electricity by applying the stepped-up voltage Vs to the bootstrap capacitor 41.

The constitution of the switching unit 24 is not particularly limited as long as a charging path through which the bootstrap capacitor 41 is charged with electricity can be switched to the first charging path or the second charging path. The switching unit 24 may have, for example, a three-way switch.

For example, the switching unit 24 includes a first terminal 24*a*, a second terminal 24*b*, and a third terminal 24*c*. The switching unit 24 can switch between a first state in which the first terminal 24*a* is electrically connected to the third terminal 24*c* and a second state in which the second terminal 24*b* is electrically connected to the third terminal 24*c*. The first terminal 24*a* is connected to an output terminal of the first voltage generation unit 21. The second terminal 24*b* is connected to an output terminal of the second voltage generation unit 22. The third terminal 24*c* is connected to the anode of the diode 40. The switching unit 24 switches the charging path to the first charging path through which the bootstrap capacitor 41 is charged with electricity by performing control so that the first state is provided using the control unit 37. The switching unit 24 switches the charging path to the second charging path through which the bootstrap capacitor 41 is charged with electricity by performing control so that the second state is provided using the control unit 37.

The first switching element 25 is, for example, a MOS transistor and is provided between an output end of the boost circuit 20 and the first end portion of the solenoid coil 4. That is to say, the first switching element 25 has a drain connected to the output terminal of the boost circuit 20 and a source connected to the first end portion of the solenoid coil 4 via the resistor 36. A gate of the first switching element 25 is connected to the control unit 37. A turning-on/off (closing/opening) operation of the first switching element 25 is controlled by the control unit 37.

The second switching element 26 is, for example, a MOS transistor and is provided between the output terminal of the battery BT and the first end portion of the solenoid coil 4. The second switching element 26 has a drain connected to the output terminal of the battery BT via the second diode 30 and a source connected to the first end portion of the solenoid coil 4 via the resistor 36. A gate of the second switching element 26 is connected to the control unit 37. A turning-on/off (closing/opening) operation of the second switching element 26 is controlled by the control unit 37.

A third switching element 27 is, for example, a MOS transistor and has a drain connected to the second end portion of the solenoid coil 4 and a source connected to the first end portion of the current detection resistor 31. Agate of the third switching element 27 is connected to the control unit 37. A turning-on/off (closing/opening) operation of the third switching element 27 is controlled by the control unit 37.

The fourth switching element 28 is, for example, a MOS transistor and has a drain connected to the first end portion of the solenoid coil 4 and a source connected to the ground (GND: a reference potential). Agate of the fourth switching element 28 is connected to the control unit 37. A turning-on/off (closing/opening) operation of the fourth switching element 28 is controlled by the control unit 37. The fourth switching element 28 is a switch configured to form a path for a regenerative current when an ON state (an opened state) is provided. The fourth switching element 28 corresponds to the synchronous switching element described above.

The first diode 29 has a cathode connected to the output terminal of the boost circuit 20 and an anode connected to the second end portion of the solenoid coil 4.

The second diode 30 has a cathode connected to the drain of the second switching element 26 and an anode connected to the output terminal of the battery BT. The second diode 30 is a diode for preventing backflow. The second diode 30 prevents an output current of the boost circuit 20 from flowing into the output end of the battery BT when both of the first switching element 25 and the second switching element 26 are turned on.

The current detection resistor 31 is a shunt resistor whose first end portion is connected to the source of the fourth switching element 28 and second end portion is connected to the GND (reference potential). The current detection resistor 31 is connected in series to the solenoid coil 4 via the fourth switching element 28 and a current flowing through the solenoid coil 4 passes through the current detection resistor 31. In the current detection resistor 31, a voltage corresponding to a magnitude of a current flowing through the solenoid coil 4 (hereinafter referred to as a "detection voltage") is generated between the first end portion and the second end portion.

The first switch 32 is connected between the second end portion of the solenoid coil 4 and the GND. The first switch 32 includes a first terminal 32*a* and a second terminal 32*b* and can switch between an ON state in which the first terminal 32*a* is electrically connected to the second terminal 32*b* and an OFF state in which the first terminal 32*a* is disconnected to the second terminal 32*b*. The first switch 32 is controlled by the control unit 37. The first terminal 32*a* is connected to the second end portion of the solenoid coil 4. The second terminal 32*b* is connected to the first end portion of the limiting resistor 33. The first switch 32 may be, for example, an electrical switch such as a transistor or a mechanical switch.

The limiting resistor 33 has a first end portion connected to the first switch 32 and a second end portion connected to the GND.

The second switch 34 is connected between the first end portion of the solenoid coil 4 and the GND. The second switch 34 includes a first terminal 34*a* and a second terminal 34*b* and can switch between an ON state in which the first terminal 34*a* is electrically connected to the second terminal 34*b* and an OFF state in which the first terminal 34*a* is disconnected to the second terminal 34*b*. The second switch 34 is controlled by the control unit 37. The first terminal 34*a* is connected to the first end portion of the solenoid coil 4 via the resistor 36. The second terminal 34*b* is connected to the first end portion of the limiting resistor 35. The second switch 34 may be, for example, an electrical switch such as a transistor or a mechanical switch. The second switch 34 is a switch configured to cause the bootstrap capacitor 41 to be charged with electricity.

The limiting resistor 35 has a first end portion connected to the second switch 34 and a second end portion connected to the GND.

The resistor 36 has a first end portion connected to the second end portion of the bootstrap capacitor 41 and the first terminal 34*a* of the second switch 34, and a second end portion connected to the first end portion of the solenoid coil 4.

The control unit 37 controls the boost circuit 20, the switching unit 24, the first switching element 25 to the fourth switching element 28, the first switch 32, and the second switch 34 on the basis of a command signal input from a higher-ordered control system. For example, the control unit 37 is composed of an integrated circuit (IC) such as a microprocessor such as a CPU or an MPU and a microcontroller such as an MCU. Functional units of the control unit 37 will be described below.

The control unit 37 includes a boost control unit 50, a switching control unit 51, a drive control unit 52, a current detection unit 53, a valve opening detection unit 54, a limiting resistor 55, and an abnormality detection unit 56.

The boost control unit 50 generates a boost control signal (a PWM signal) formed to control an operation of the boost circuit 20 and outputs the generated boost control signal to the boost circuit 20. Thus, the boost circuit 20 generates a stepped-up voltage Vs.

The switching control unit 51 control a switching operation of the switching unit 24. For example, when the battery voltage Vb falls below a prescribed value Vth, the switching control unit 51 controls the switching unit 24 such that a charging path for the bootstrap circuit 23 is switched from the first charging path to the second charging path. For example, when the battery voltage Vb is the prescribed value Vth or higher, the switching control unit 51 controls the switching unit 24 such that it is brought into the first state, to control the charging path for the bootstrap circuit 23 such that it is the first charging path. The switching control unit 51 controls the switching unit 24 to be in the second state only when the battery voltage Vb falls below the prescribed value Vth to perform control so that the charging path is the second charging path. For example, the prescribed value Vth is a threshold value for determining whether a sufficient voltage of the battery BT is provided and is set in advance. Here, the "sufficient voltage of the battery BT" means, for example, a voltage sufficient for the first voltage generation unit 21 to generate the first voltage V1. For example, the prescribed value Vth is a voltage value higher than a voltage obtained by adding a voltage corresponding to an amount of stepped-down using the first voltage generation unit 21 to the first voltage V1.

The drive control unit 52 includes a charging control unit 60, an electricity conduction control unit 61, and a regeneration control unit 62.

The charging control unit 60 controls the second switch 34 to be in an ON state or an OFF state. The charging control unit 60 controls the second switch 34 to be in an ON state to cause the bootstrap capacitor 41 to be charged with electricity. Thus, the bootstrap circuit 23 generates a boot voltage Vboot. For example, the charging control unit 60 controls the second switch 34 to be in an ON state at regular intervals of T1 before fuel is injected into an internal combustion engine installed in the vehicle to perform intermittent charging for intermittently causing the bootstrap capacitor 41 to be charged with electricity.

The electricity conduction control unit 61 controls the first switching element 25 to be in an ON state or an OFF state. To be specific, the electricity conduction control unit 61 generates a first gate signal for controlling the first switching element 25 and outputs the first gate signal to the gate of the first switching element 25. Thus, the first switching element 25 is in an ON state.

The electricity conduction control unit 61 controls the second switching element 26 to be in an ON state or an OFF state. To be specific, the electricity conduction control unit 61 generates a second gate signal for controlling the second switching element 26 and outputs the second gate signal to the gate of the second switching element 26. Thus, the second switching element 26 is in an ON state.

The electricity conduction control unit 61 controls the third switching element 27 to be in an ON state or an OFF state. To be specific, the electricity conduction control unit 61 generates a third gate signal for controlling the third switching element 27 and outputs the third gate signal to the gate of the third switching element 27. Thus, the third switching element 27 is in an ON state.

The regeneration control unit 62 controls the fourth switching element 28 to be in an ON state or an OFF state. To be specific, the regeneration control unit 62 generates a fourth gate signal for controlling the fourth switching element 28 and outputs the fourth gate signal to the gate of the fourth switching element 28. Thus, the fourth switching element 28 is in an ON state.

The abnormality control unit 63 controls both of the fourth switching element 28 and the first switch 32 to be in an ON state in an abnormality detection mode in which the presence or absence of an abnormality of the fourth switching element 28 is detected. The abnormality detection mode is performed in a prescribed period before the fuel injection valve L is opened. For example, the prescribed period is an arbitrary period from a time at which an ignition switch of the vehicle is operated to be in an ON state to a time before the electricity conduction of the solenoid coil 4 starts to open the fuel injection valve L. The abnormality may be, for example, the case where the line wiring connecting the drain of the fourth switching element 28 to the first end portion of the solenoid coil 4 is disconnected.

A voltage detection unit 64 detects a voltage Vfbh which is a voltage of the first end portion of the solenoid coil 4 in the abnormality detection mode. To be specific, the voltage detection unit 64 detects a voltage Vfbh when both of the fourth switching element 28 and the first switch 32 are in an ON state. Here, the voltage detection unit 64 does not detect a voltage Vfbh when the second switch 34 is in an ON state. That is to say, the voltage detection unit 64 in the embodiment detects a voltage Vfbh when the second switch 34 is in an OFF state and both of the fourth switching element 28 and the first switch 32 are in an ON state.

The current detection unit 53 includes a pair of input terminals, one of the input terminals is connected to one end of the current detection resistor 31, and the other of the input terminals is connected to the other end of the current detection resistor 31. The current detection unit 53 receives, as an input, a detection voltage generated using the current detection resistor 31 and detects a detection current on the basis of the detection voltage. The current detection unit 53 outputs the detected detection current to the valve opening detection unit 54 and the drive control unit 52.

The valve opening detection unit 54 detects the opening of the fuel injection valve L on the basis of the detection current input from the current detection unit 53. To be specific, the valve opening detection unit 54 detects the opening of the fuel injection valve L by specifically identifying an inflection point in a first-order differential value or a second-order differential value of the detection current detected by the current detection unit 53.

The limiting resistor 55 is provided between the battery BT and the second switch 34. The limiting resistor 55 has a first end portion connected to the output terminal of the battery BT and a second end portion connected to the first terminal 34*a* of the second switch 34.

The abnormality detection unit 56 detects an abnormality of the fourth switching element 28 on the basis of the voltage Vfbh detected by the voltage detection unit 64 in the abnormality detection mode. The abnormality detection unit 56 detects an abnormality of the fourth switching element 28 on the basis of the voltage Vfbh detected by the voltage detection unit 64 when the drive control unit 52 controls the fourth switching element 28 to be in an ON state.

An operation of the abnormality detection mode of the electromagnetic valve driving device 1 according to the embodiment will be described below with reference to FIG. 3 to FIG. 6.

In a first period T1 before the fuel injection valve L is opened, the operation of the control unit 37 transitions to the abnormality detection mode and performs determination once or more whether there is an abnormality in the fourth switching element 28. For example, the MCU included in the control unit 37 performs initial processing in the first period T1 if the ignition switch is operated to be in an ON state. The operation of the control unit 37 transitions to the abnormality detection mode during a period during which the initial processing is performed and determines whether there is an abnormality in the fourth switching element 28.

The control unit 37 controls both of the fourth switching element 28 and the first switch 32 to be in an ON state if the mode transitions to the abnormality detection mode and detects a voltage Vfbh which is a voltage at the first end portion of the solenoid coil 4.

Figure 3:
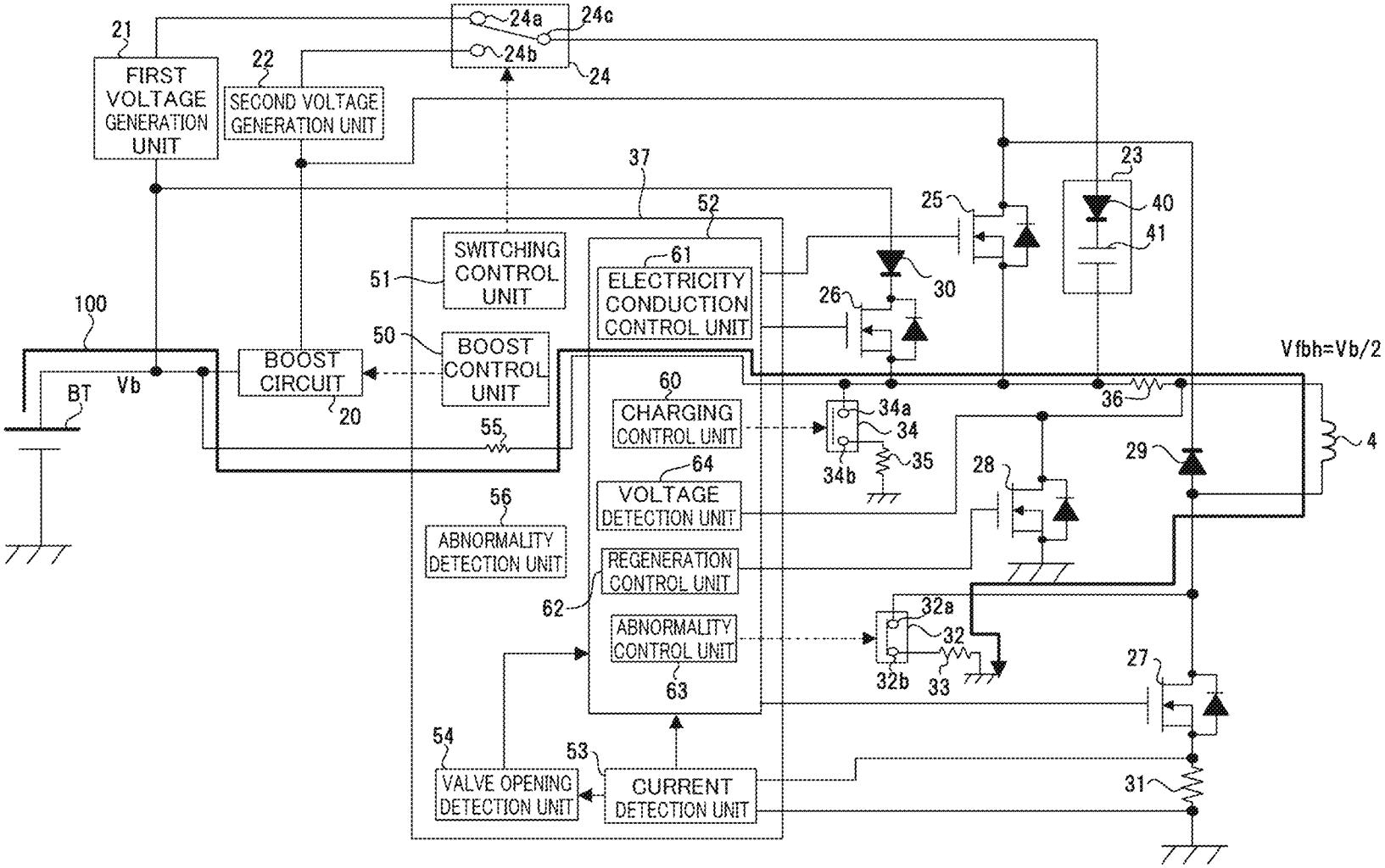
FIG. 3 is a circuit diagram for explaining an abnormality detection mode according to the embodiment.
Figure 4:
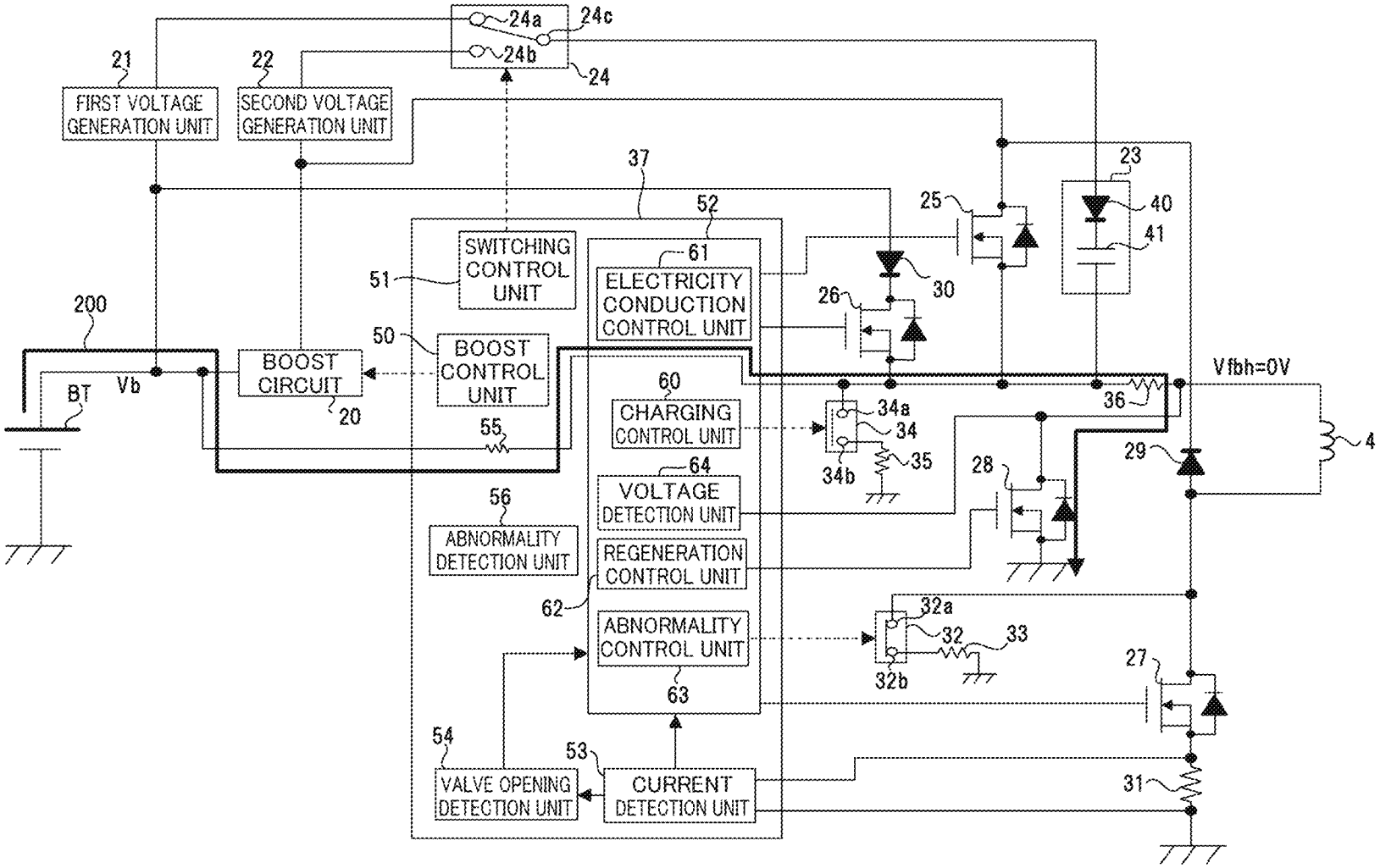
FIG. 4 is a circuit diagram for explaining an abnormality detection mode according to the embodiment.

When an abnormality does not occur in the fourth switching element 28, if the fourth switching element 28 is in an OFF state and if the first switch 32 is in an ON state, then a current from the battery BT flows through a path 10 through which the current flows to the GND via the resistor 36, the solenoid coil 4, and the first switch 32 (FIG. 3). At this time, resistance values of the limiting resistor 55, the resistor 36, and the limiting resistor 33 are adjusted so that the voltage Vfbh becomes Vb/2 through the resistance voltage division. Here, if the fourth switching element 28 is controlled to be in an ON state, a current from the battery BT passes through a path 200 through which the current flows to the GND via the resistor 36 and the fourth switching element 28 (FIG. 4). Therefore, the voltage Vfbh is reduced to a reference potential (for example, 0 V). That is to say, when an abnormality does not occur in the fourth switching element 28, if the fourth switching element 28 and the first switch 32 are controlled to be in an ON state, the voltage Vfbh is a reference potential (for example, 0 V).

Figure 5:
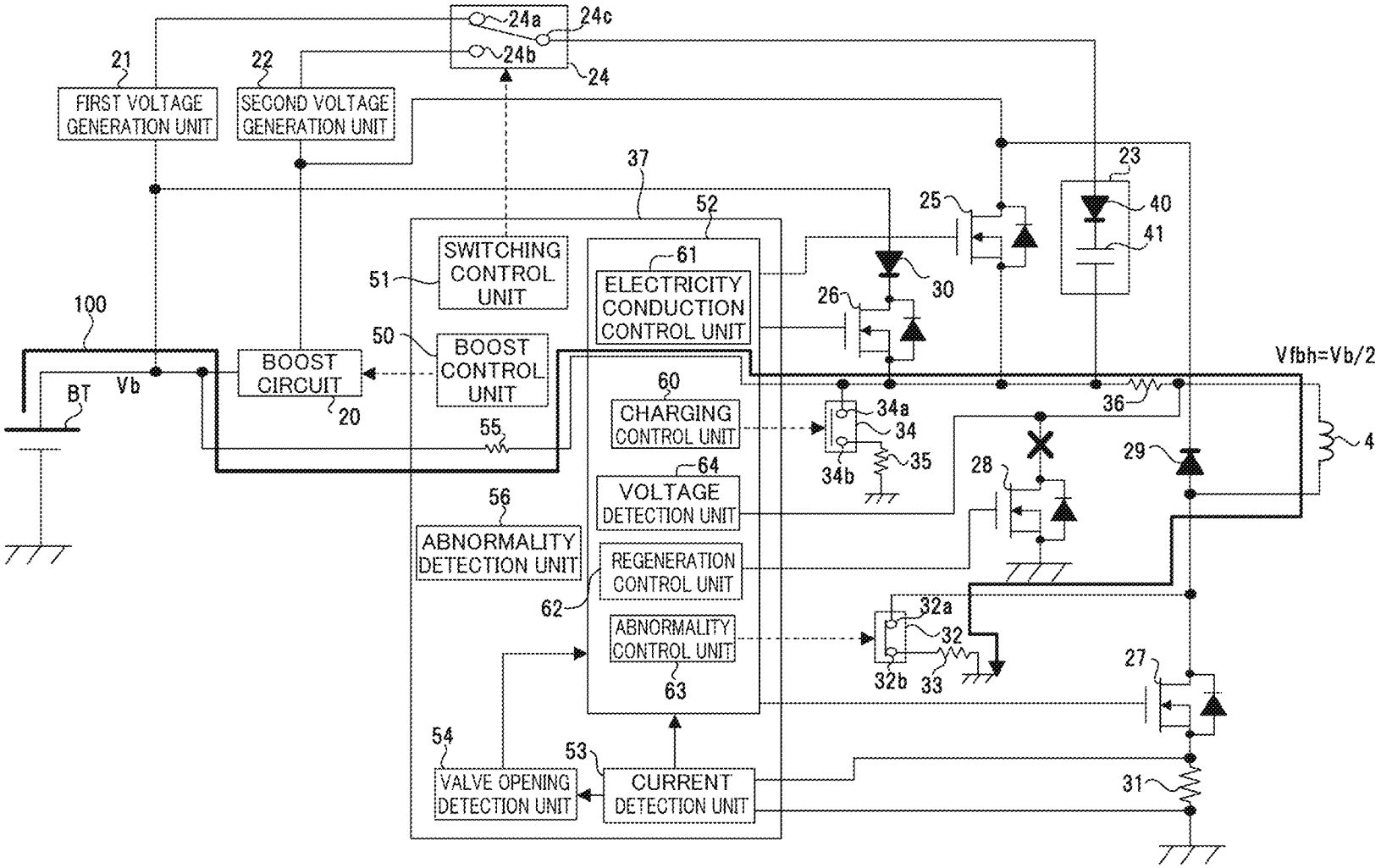
FIG. 5 is a circuit diagram for explaining an abnormality detection mode according to the embodiment.

On the other hand, as illustrated in FIG. 5, when an abnormality in which a position indicated by "x" is disconnected occurs, the drain of the fourth switching element 28 is opened. In this case, if the fourth switching element 28 and the first switch 32 are controlled to be in an ON state, a current from the battery BT flows through the path 100 as in FIG. 3. Therefore, the voltage Vfbh becomes Vb/2.

Thus, the control unit 37 determines that the fourth switching element 28 is normal when the voltage Vfbh detected in the abnormality detection mode is a reference potential and determines that the fourth switching element 28 is abnormal when the voltage Vfbh becomes Vb/2. For example, the control unit 37 detects an abnormality of the fourth switching element 28 when the voltage Vfbh detected in the abnormality detection mode is the prescribed value or higher. The prescribed value is a value between 0 V and Vb/2.

In this way, since a potential difference occurs in the voltage Vfbh between a case in which the fourth switching element 28 is in an ON state and a state in which the fourth switching element 28 is in an OFF state, the control unit 37 determines whether there is an abnormality in the fourth switching element 28 using the potential difference.

Figure 6:
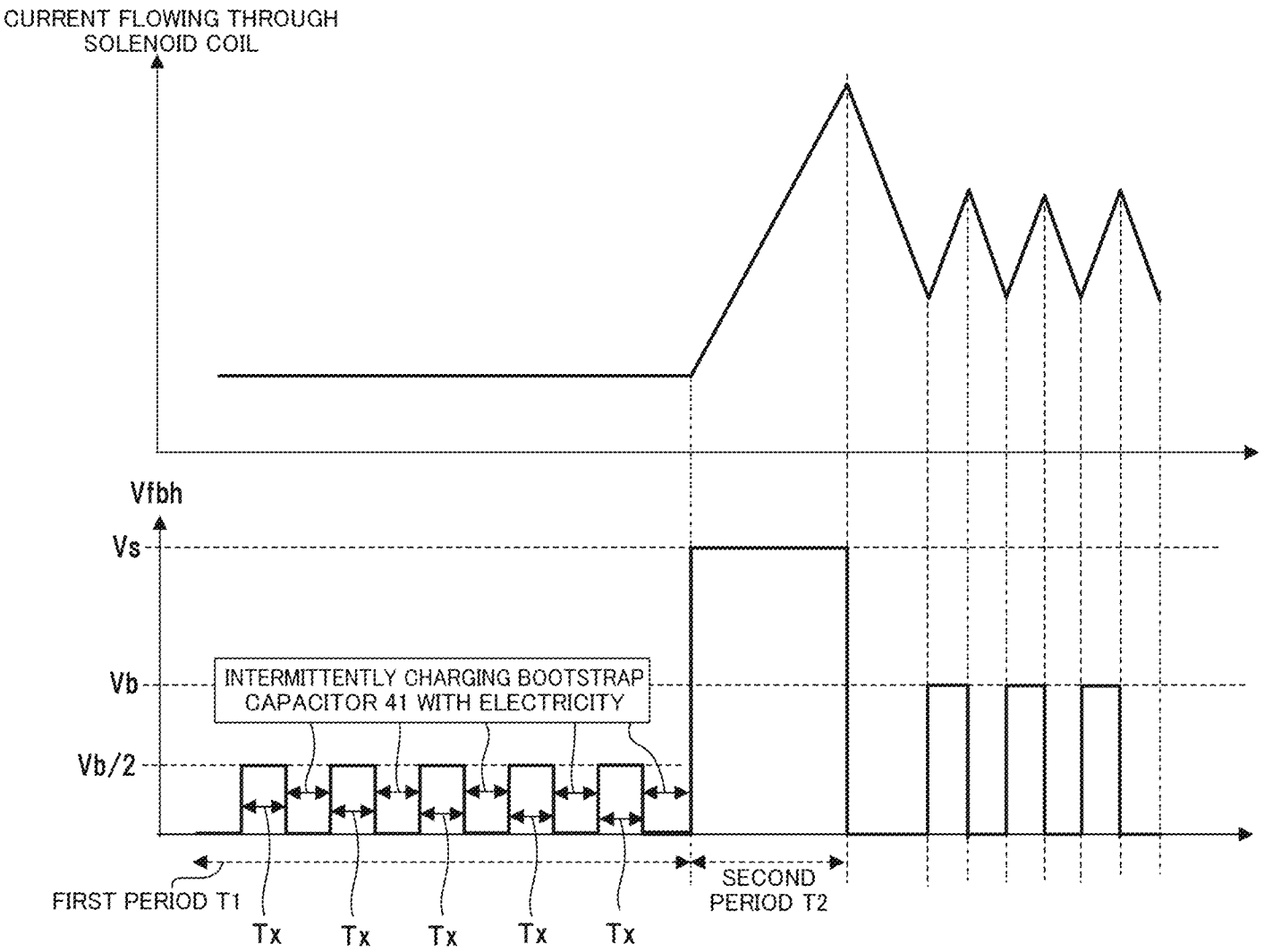
FIG. 6 is a diagram illustrating an operation timing of the electromagnetic valve driving device according to the embodiment.

Here, the control unit 37 may intermittently cause the bootstrap capacitor 41 to be charged with electricity in the first period T1 in some cases (FIG. 6). To be specific, the control unit 37 intermittently controls the second switch 34 to be in an ON state in the first period T1 to intermittently cause the bootstrap capacitor 41 to be charged with electricity. Thus, the bootstrap circuit 23 generates a boot voltage Vboot. Here, when the second switch 34 is in an ON state, the voltage Vfbh is reduced to a reference potential or a value close to the reference potential regardless of whether the fourth switching element 28 is in an ON state. For this reason, if the voltage Vfbh at this time is used for determining an abnormality of the fourth switching element 28, there is a concern that an erroneous determination may be occurred. For this reason, the control unit 37 detects a voltage Vfbh during at least one period of periods Tx in which the second switch 34 is not in an ON state. Thus, in the first period T1, the control unit 37 can generate a boot voltage Vboot using the bootstrap circuit 23 and can determine an abnormality of the fourth switching element 28. The waveform of the voltage Vfbh in the first period T1 illustrated in FIG. 6 is a waveform when the fourth switching element 28 is normal in which the abnormality detection mode is not performed (when the fourth switching element 28 is not controlled to be in an ON state).

When the fuel injection valve L is driven from a closed valve state to an opened valve state using the electromagnetic valve driving device 1, the control unit 37 causes the mode to be released from the abnormality detection mode and supplies the stepped-up voltage Vs generated by the boost circuit 20 to the fuel injection valve L in a second period T2 at the start of driving as illustrated in FIG. 6. Here, when it is determined in the abnormality detection mode that there is an abnormality in the fourth switching element 28, the system is stopped without driving the fuel injection valve L to be in an opened valve state. That is to say, the control unit 37 causes the injection of fuel to stop without supplying the stepped-up voltage Vs to the fuel injection valve L.

For example, the second period T2 is a period until a current flowing through the solenoid coil 4 exceeds a threshold value set in advance from when the stepped-up voltage Vs is supplied to the solenoid coil 4.

In the second period T2, the electricity conduction control unit 61 outputs the first gate signal to the gate of the first switching element 25 to supply the stepped-up voltage Vs to the first end portion of the solenoid coil 4 and outputs the third gate signal to the third switching element 27 to connect the second end portion of the solenoid coil 4 to the GND (the reference potential) via the current detection resistor 31.

As a result, in the second period T2, as illustrated in FIG. 6, a relatively high stepped-up voltage Vs is supplied to the solenoid coil 4 and a peak-shaped rising drive current flows through the solenoid coil 4. Such a drive current forms a magnetic path in which the fixed core 2 and the movable core 10 are included and the movable core 10 is moved toward the fixed core 2 side (upward) due to an attractive force generated due to this magnetic path. That is to say, the needle 5 moves upward due to an attractive force caused by the drive current and thus the valve body 6 is separated from the valve seat 3.

Here, in the second period T2, a stepped-up voltage Vs having a voltage higher than the battery voltage Vb is used to increase a speed of the rising of the drive current and increase a speed of a valve opening operation of the fuel injection valve L. That is to say, in the second period T2, a valve opening rate of the fuel injection valve L is increased due to the drive current as compared with a case in which the battery voltage is used.

If the second period T2 elapses, the electricity conduction control unit 61 causes the output of the first gate signal to stop and stops the supply of the stepped-up voltage Vs to the solenoid coil 4. In this case, the first switching element 25, the second switching element 26, and the fourth switching element 28 are in an OFF state and the third switching element 27 is in an ON state.

When the supply of the stepped-up voltage Vs to the solenoid coil 4 is stopped using the electricity conduction control unit 61, the regeneration control unit 62 outputs the fourth gate signal to the gate of the fourth switching element 28 to regenerate a current caused by a back electromotive force of the solenoid coil 4 (hereinafter referred to as a "regenerative current") to the GND.

To be specific, if the regeneration control unit 62 controls the fourth switching element 28 to be in an ON state, the regenerative current generated due to the back electromotive force of the solenoid coil 4 returns from the solenoid coil 4 to the solenoid coil 4 via the third switching element 27, the current detection resistor 31, the GND, and the fourth switching element 28.

Here, if there is an abnormality in the fourth switching element 28, a path through which the regenerative current is returned to the solenoid coil 4 is removed. Thus, when a back electromotive voltage is generated in the solenoid coil 4, a current exceeding a specified value is likely to flow from the control unit 37 toward the solenoid coil 4. In the embodiment, the control unit 37 determines an abnormality of the fourth switching element 28 on the basis of the voltage Vfbh which is a voltage of the first end portion of the solenoid coil 4. Thus, it is possible to detect an abnormality of the fourth switching element 28 and it is possible to prevent a current exceeding a specified value from flowing from the control unit 37 toward the solenoid coil 4.

When the fourth switching element 28 is normal, an electromotive voltage of the solenoid coil 4 gradually decreases with the passage of time due to the flow of the regenerative current. Moreover, although a current flowing through the solenoid coil 4 gradually attenuates mainly due to a decrease in the electromotive voltage, the movable core 10 continues to move toward the fixed core 2 side and finally collides with the fixed core 2.

If the valve opening detection unit 54 detects the valve opening of the fuel injection valve L, the electricity conduction control unit 61 causes the solenoid coil 4 to output a battery voltage Vb lower than the stepped-up voltage Vs. For example, the electricity conduction control unit 61 outputs the second gate signal to the second switching element 26 to supply the battery voltage Vb to the first end portion of the solenoid coil 4 and output the third gate signal to the third switching element 27.

In this way, if the valve opening detection unit 54 detects the valve opening of the fuel injection valve L, the electricity conduction control unit 61 causes the solenoid coil 4 to output a battery voltage Vb lower than the stepped-up voltage to maintain the opened valve state of the fuel injection valve L. At this time, the first switching element 25 and the fourth switching element 28 are in an OFF state and the second switching element 26 and the third switching element 27 are in an ON state.

Here, the electricity conduction control unit 61 performs feedback control so that a holding current for holding the opened valve state of the fuel injection valve L maintains a prescribed target value on the basis of the magnitude of the detection current detected by the current detection unit 53. Although this is performed by appropriately supplying the second gate signal to the second switching element 26, a pulse width modulation (PWM) signal can also be used. When the PWM signal is used, a PWM signal having a prescribed duty ratio is supplied to the second switching element 26 as a second gate signal. For this reason, the battery voltage Vb is intermittently supplied to the solenoid coil 4.

The duty ratio is set on the basis of the magnitude of the detection current detected by the current detection unit 53. That is to say, the electricity conduction control unit 61 sets the duty ratio of the PWM signal on the basis of the magnitude of the detection current detected by the current detection unit 53 to perform feedback control so that the holding current for holding the opened valve state of the fuel injection valve L maintains a prescribed target value. As a result, the opened valve state of the fuel injection valve L is maintained. Furthermore, the drive current may be changed stepwise by changing the duty ratio in two steps.

As described above, the control unit 37 detects an abnormality of the fourth switching element 28 which is a regenerative switching element on the basis of the voltage Vfbh which is a voltage of the first end portion of the solenoid coil 4. With this constitution, it is possible to detect an abnormality in the synchronous switching element, and when an abnormality occurs in the synchronous switching element, it is possible to minimize the flow of a current exceeding a specified value inside the control unit 37.

Although the control unit 37 detects an abnormality of the fourth switching element 28 when the voltage Vfbh detected by the voltage detection unit is a prescribed value or higher before the fuel injection valve L is driven, the present invention is not limited to only this constitution. For example, the operation of the control unit 37 may periodically transition to the abnormality detection mode also when the fuel injection valve L is driven and detect an abnormality of the fourth switching element 28. In this case, the control unit 37 may immediately stop the driving of the fuel injection valve L when an abnormality of the fourth switching element 28 is detected and cause the injection of fuel to stop.

All or a part of the control unit 37 described above may be implemented using a computer. In this case, the computer may include a processor such as a CPU and a GPU and a computer-readable recording medium. Moreover, all or a part of the control unit 37 described above may be realized by recording a program for realizing all or a part of the functions of the control unit 37 on the computer on the computer-readable recording medium, reading the program recorded on the recording medium in the processor, and executing the program. Here, a "computer-readable recording medium" refers to a portable medium such as a flexible disk, a magneto-optical disk, a ROM, a CD-ROM, or a storage device such as a hard disk built in a computer system. Furthermore, a "computer-readable recording medium" is a medium configured to dynamically hold a program for a short period of time such as a communication line when a program is transmitted via a network such as the Internet or a communication circuit such as a telephone circuit and a medium configured to hold a program for a certain period of time such as a volatile memory inside a computer system which serves as a server or a client in that case. In addition, the program may be a program for realizing a part of the above functions, a program for realizing the above functions in combination with a program recorded in the computer system in advance, or a program realized using a programmable logic device such as an FPGA.

According to the electromagnetic valve driving device of the present invention, it is possible to detect an abnormality of the synchronous switching element.

EXPLANATION OF REFERENCES

1 Electromagnetic valve driving device
23 Bootstrap circuit
25 First switching element
26 Second switching element
27 Third switching element
28 Fourth switching element
32 First switch
34 Second switch
37 Control unit
63 Abnormality control unit
64 Voltage detection unit

What is claimed is:

1. An electromagnetic valve driving device which drives a fuel injection valve having a solenoid coil, comprising:

a regenerative switching element disposed between a first end portion of the solenoid coil and a ground; and a control unit configured to control the regenerative switching element to be in an ON state or an OFF state, wherein the control unit includes:

a voltage detection unit configured to detect a voltage of the first end portion of the solenoid coil; and an abnormality detection unit configured to detect an abnormality of the regenerative switching element on the basis of the voltage detected by the voltage detection unit.

2. The electromagnetic valve driving device according to claim 1, wherein the control unit includes a drive control unit configured to control the regenerative switching element to be in an ON state or an OFF state, and wherein the abnormality detection unit detects an abnormality of the regenerative switching element on the basis of the voltage detected by the voltage detection unit when the drive control unit controls the regenerative switching element to be in an ON state.

3. The electromagnetic valve driving device according to claim 2, wherein the abnormality detection unit detects an abnormality of the regenerative switching element when the voltage detected by the voltage detection unit is a prescribed value or higher before the fuel injection valve is driven.

4. The electromagnetic valve driving device according to claim 3, further comprising:

a boost circuit configured to step up a battery voltage which is an output voltage of a battery;

a first switching element disposed between the boost circuit and the first end portion of the solenoid coil;

a second switching element disposed between the battery and the first end portion;

a third switching element disposed between a second end portion of the solenoid coil and a ground; and a first switch which is disposed between the second end portion and a ground and is different from the third switching element, wherein, when the voltage detected by the voltage detection unit is the prescribed value or higher, the abnormality detection unit detects an abnormality of the regenerative switching element if both of the regenerative switching element and the first switch are in an ON state.

5. The electromagnetic valve driving device according to claim 4, further comprising:

a bootstrap capacitor configured to generate a voltage required for turning on the first switching element and the second switching element; and a second switch disposed between the bootstrap capacitor and a ground, wherein the drive control unit controls the second switch to be in an ON state to cause the bootstrap capacitor to be charged with electricity, and when the second switch is in an OFF state and both of the regenerative switching element and the first switch are in an ON state, the abnormality detection unit detects an abnormality of the regenerative switching element if the voltage detected by the voltage detection unit is the prescribed value or higher.

6. The electromagnetic valve driving device according to claim 1, wherein the control unit stops the driving of the fuel injection valve when an abnormality of the regenerative switching element is detected.

* * * * *